United States Patent [19]

Krauss et al.

[11] Patent Number: 4,793,869

[45] Date of Patent: Dec. 27, 1988

[54] CONTINUOUS TREATMENT OF COLD-ROLLED CARBON MANGANESE STEEL

[75] Inventors: George Krauss, Evergreen, Colo.; Philip M. Roberts, Naperville, Ill.

[73] Assignee: Signode Corporation, Glenview, Ill.

[21] Appl. No.: 37,185

[22] Filed: Apr. 10, 1987

[51] Int. Cl.[4] ..... C21D 8/00

[52] U.S. Cl. ..... 148/12.1; 148/12 F; 148/15; 148/156

[58] Field of Search ..... 148/134, 14, 15, 156, 148/12.1, 12.4, 12 F

[56] References Cited

U.S. PATENT DOCUMENTS

| | | | |
|---|---|---|---|
| 1,561,577 | 11/1925 | Trautman | 134/122 R |
| 1,561,578 | 11/1925 | Trautman | 373/128 |
| 1,561,579 | 11/1925 | Trautman | 148/15 |
| 1,700,002 | 1/1929 | Trautman | 373/119 |
| 1,810,612 | 6/1931 | Kathner | 148/156 |
| 1,937,420 | 11/1933 | Wood et al. | 219/11 |
| 2,019,555 | 11/1935 | Wood et al. | 219/11 |
| 2,164,850 | 7/1939 | Wood et al. | 148/4 |
| 2,224,998 | 12/1940 | Wood et al. | 148/10 |
| 2,300,329 | 10/1942 | Wood et al. | 148/10 |
| 2,304,225 | 12/1942 | Wood et al. | 219/11 |
| 2,345,181 | 3/1944 | Cooper et al. | 13/25 |
| 2,462,202 | 2/1949 | Kniveton | 148/13 |
| 2,716,079 | 8/1955 | Wick et al. | 148/10 |
| 2,832,709 | 4/1958 | Sendzimir | 148/13 |
| 2,864,607 | 12/1958 | Renkin | 266/3 |
| 2,892,744 | 6/1959 | Myers | 148/16 |
| 3,163,566 | 12/1964 | Jenkins et al. | 148/150 |
| 3,181,977 | 5/1965 | Sturgeon | 148/13.1 |
| 3,235,416 | 2/1966 | Jenkins | 148/129 |
| 3,239,201 | 3/1966 | Simich et al. | 266/3 |
| 3,277,270 | 10/1966 | Trautman | 219/155 |
| 3,421,951 | 1/1969 | Shelton | 148/39 |
| 3,615,926 | 10/1971 | Taylor | 148/143 |
| 3,711,342 | 1/1973 | Cullen et al. | 148/134 |
| 3,761,323 | 9/1973 | Hunt et al. | 148/12 |
| 3,795,550 | 3/1974 | Henreich et al. | 148/134 |
| 3,902,927 | 9/1975 | Pernstal | 148/12 |
| 3,936,324 | 2/1976 | Uchida et al. | 148/12 F |
| 3,951,696 | 4/1976 | Gondo et al. | 148/12 |
| 4,050,959 | 9/1977 | Nakaoka et al. | 148/12.3 |
| 4,159,218 | 1/1979 | Chatfield et al. | 148/12 |
| 4,243,441 | 1/1981 | Wilson | 148/128 |
| 4,336,080 | 6/1982 | Nakaoka et al. | 148/12 |
| 4,363,472 | 12/1982 | Shimoyama et al. | 266/111 |
| 4,394,186 | 7/1983 | Furukawa et al. | 148/12 |
| 4,407,680 | 10/1983 | Gladman et al. | 148/12 |
| 4,436,561 | 3/1984 | Takahashi et al. | 148/12 |
| 4,440,583 | 4/1984 | Ikegami et al. | 148/128 |
| 4,448,614 | 5/1984 | Morimoto et al. | 148/12.1 |

FOREIGN PATENT DOCUMENTS 1608163 10/1973 Fed. Rep. of Germany .

OTHER PUBLICATIONS

S. F. Radtke, Cosmos Engineering Inc. (USA).

Paulus et al, Study of the Heat Buckling and Shape Problems in Continuous Heat Treating Lines and Discussion of Proposed Solutions, pp. 424–439.

Inland Steel, MartlNsite®, Ultra High Strength Steel for Today's Needs, pp. 1–10.

High Strength, Low Alloy Steel–SAE J410, Jun. 1984, pp. 1.86–1.88.

*Primary Examiner*—Christopher W. Brody

*Attorney, Agent, or Firm*—Wood, Herron & Evans

[57] ABSTRACT

Cold-rolled, non-microalloyed carbon manganese steel (0.04% to 0.15% C, 0.25% to 0.70% Mn) is preheated at 700° to 1000° F., heated to 1625° to 1725° F., and quenched to 650° to 750° F. in a continuous process to develop minimum yield strength of 40,000 psi, minimum tensile strength of 50,000 psi, and 22% minimum elongation.

8 Claims, 2 Drawing Sheets

CONTINUOUS TREATMENT OF COLD-ROLLED CARBON MANGANESE STEEL

BACKGROUND OF THE INVENTION

There exists today a group of steels which are characterized by among other things enhanced mechanical properties including higher yield strengths and tensile strengths than plain carbon structural steels. These are known as high-strength, low-alloy (HSLA) steels. Different types of HSLA steels are available, some of which are carbon-manganese steels and others of which are microalloyed by additions of such elements as niobium, vanadium, and titanium to achieve enhanced mechanical properties. The original demand for HSLA steels arose from the need to obtain improved strength-to-weight ratios to reduce dead weight in transportation equipment. In addition to the original uses, HSLA steels are used today in a wide range of applications including vehicles, construction machinery, materials-handling equipment, bridges and buildings.

Commercial HSLA steels typically have minimum yield strengths of 40 to 50 ksi and minimum tensile strengths of 60 to 70 ksi. The mechanical properties and other characteristics of HSLA steels are set forth in standard specifications such as SAE J410c. Under these specifications, HSLA steels are produced to specified mechanical properties in their hot rolled condition. That is, the mechanical properties of HSLA steels depend on their hot rolled condition. These steels are not heat treated except for any annealing, normalizing or stress relieving done subsequent to cold reduction. Heat treated grades are available as plate, bars and, occasionally, sheet and structural shapes and depend on either precipitation hardening or quenching and tempering to develop the specified mechanical properties.

One grade of high-strength low-alloy steel under SAE J410c is grade 950 A,B,C,D, which is characterized by a minimum yield strength (0.2% offset) of 50,000 psi, minimum tensile strength of 70,000 psi, and minimum elongation (2-inch specimen) of 22%. This material exhibits its mechanical properties as hot rolled, and when later cold reduced to sheet thickness, is subjected to a low temperature recovery anneal for an extended period of time to maintain the as-rolled mechanical properties. This recovery anneal is disadvantageous because of either the extended times required for box annealing or the enormous investment required for equipment for continuous annealing.

There thus exists today a need for steels possessing the desired combination of strength and ductility required for HSLA steel applications but which can be produced economically from cold reduced sheet stock without the need for extended recovery annealing. Moreover, there exists a need for such steels wherein the higher mechanical properties, particularly yield strength and tensile strength, are achieved without the intentional inclusion of microalloying agents such as niobium, titanium and vanadium, which otherwise would add significantly to the cost of the steel.

SUMMARY OF THE INVENTION

It is among the principal objectives of this invention to provide a method for treating cold reduced steel compositions characterized by a relatively low carbon low alloy content and the absence of expensive microalloying agents which nevertheless exhibit in the treated condition mechanical properties, ie., yield strength, tensile strength, and elongation, meeting the specifications for high-strength low-alloy steels, for example, grade 950 A,B,C,D of SAE J410c. Moreover, it is among the principal objectives of this invention to provide such a method for producing cold reduced steels having the uniformly higher mechanical properties of the HSLA steels which can be produced in a continuous process at relatively high speed and very economically.

To these ends, the present invention is directed to low carbon, low manganese steel compositions and to a heat treatment method therefor. The steel compositions included within this invention have a carbon content ranging from 0.04 to 0.15% by weight carbon and 0.25 to 0.70% by weight manganese. Microalloying elements such as niobium, titanium and vanadium are not added to the steel composition to achieve enhanced mechanical properties. The steel, which is cold reduced to a desired sheet thickness, e.g., in the range of 0.020 to 0.060 inch, is passed continuously through three heating stages. The first stage is a preheating stage wherein the temperature of the cold rolled sheet is raised to a temperature in the range of about 700° F. to 1000° F. The steel is then heated to a temperature in the range of 1625° F. to 1725° F., quenched at a temperature in the range 650° F. to 750° F., and then cooled to room temperature.

The heat treatment is carried out continuously at a line speed in the range of 50 to 300 feet/minute whereby a continuous length of steel strip of desired gauge and width is passed continuously and sequentially through the three heating stages.

One presently preferred steel composition is a steel having about 0.10 to 0.15% by weight carbon and about 0.25 to 0.70% by weight manganese, the balance being iron and the normal residuals from deoxidation. When treated in accordance with the heat treatment schedule described above, the treated steel exceeds the minimum yield strength of 50,000 psi, minimum tensile strength of 70,000 psi, and minimum elongation of 22% specified for grade 950 A,B,C,D of SAE J410c specifications. Another lower carbon composition containing from about 0.04 to 0.07% by weight carbon and about 0.25 to 0.40% by weight manganese when treated by the method of this invention exhibits a minimum yield strength of 50,000 psi, minimum tensile strength of 60,000 psi, and a relatively high elongation of 28%.

The method of this invention for treating steels having relatively low carbon and low manganese contents and the absence of microalloying agents results in a cold reduced product having mechanical properties meeting or exceeding existing HSLA steel specifications. The present invention is thus characterized by the higher mechanical properties of commercial high-strength low-alloy steels but obtainable in a cold reduced low carbon and manganese steel and by the economies inherent in the relatively low carbon, low manganese content of the steel, the absence of microalloying agents, and the continuous process for the treatment of a cold reduced product.

DETAILED DESCRIPTION OF THE PREFERRED MODE

The carbon-manganese steel compositions treated by the method of this invention contain from about 0.04 to 0.15% by weight carbon and 0.25 to 0.70% by weight manganese. A presently preferred composition contains 0.10 to 0.15% by weight carbon and 0.25 to 0.70% by weight manganese. The steel is killed, preferably, aluminum killed and continuously cast, to achieve uniformity of mechanical properties. As a result, the composition can contain residual silicon and aluminum from the deoxidation process. The steel may also be a silicon killed or semi-killed steel.

Figure 1:
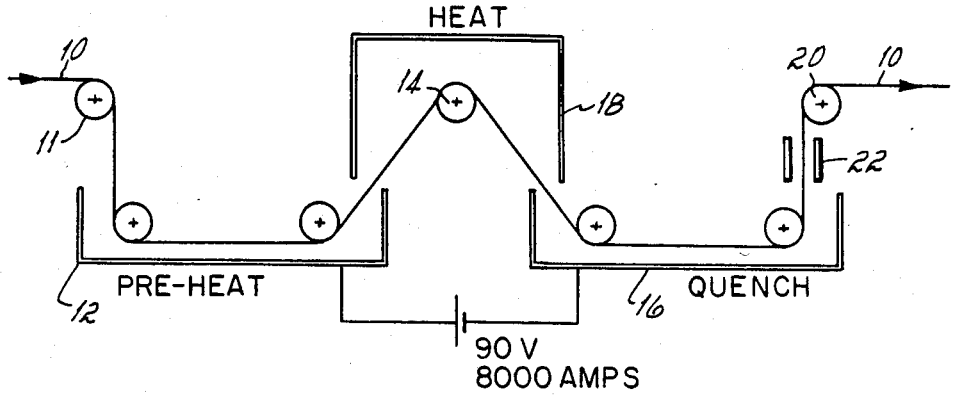
FIG. 1 is a schematic illustration of the treatment process.

Referring to FIG. 1, hot rolled coils of steel, which may be pickled and oiled, are cold reduced through a series of cold rolling passes to a sheet 10 having a desired reduced thickness, for example, on the order of 0.020 to 0.060 inch. The cold rolled and reduced sheet 10 is then passed over roller 11 and down into a preheating bath 12 which may be a bath of molten lead maintained at a temperature in the range of 700° to 1000° F. The lead bath may be heated by any of a number of means, e.g., natural gas or electricity. Alternatively to a lead bath, other media capable of providing a liquid bath having a temperature in the range of 700° to 1000° F. may be used. The material then passes upwardly out of the bath and over an elevated roller 14. The material then passes down into a second molten lead bath 16 which is the quench bath.

In the heating stage, the material is heated to a temperature in the range of 1625° to 1725° F. In the quench stage, the material is quenched at a temperature in the range of 650° to 750° F. Heating of the material in the heating stage is accomplished by resistance heating. That is, the preheat bath 12 and the quench bath 16 are maintained at a potential of about 90 volts and current of 8000 amperes with the quench bath being grounded. As a consequence, the sheet material 10 passing between the preheat bath and the quench bath shunts the current and is thereby resistance heated. The length of material passing through the heating stage, current, and travel speed are controlled to subject the material in the heating stage to the desired treatment temperature in the range of 1625° to 1725° F. A protective atmosphere is maintained in the heating stage by enveloping the sheet material 10 in an atmosphere housing 18 which is flushed with a protective exothermic gas. The gas prevents the sheet material from oxidizing as it passes from the preheat bath 12 to the quench bath 16. Alternatively to resistance heating, the material 10 may be heated by other heating means such as induction, infrared, and gas heating.

The quench bath 16 is also a lead bath which can be heated by such means as electric immersion heaters or radiant gas tubes to a temperature in the range of 650° to 750° F. After quenching, the material then passes out of the quench bath 16 and vertically upward over a roller 20 and through a charcoal chute 22 which contains ignited charcoal designed to prevent the lead from being dragged out of the quench bath on the sheet material. The sheet material which is now at a temperature of about 500° F. is then passed through a downstream water tank or water spray (not shown) to bring its temperature down to about 150° F. However, all of the transformation of the steel is completed by the time the material leaves the quench bath 16. After cooling, the material may be coiled for shipment or subsequently processed by known techniques or combination of known techniques, e.g., acid and/or abrasive cleaning, painting, plating, flattening, tension leveling, and the like.

The sheet material continuously passes through the preheat, heat and quench stages. Typical line speeds are on the order of 50 to 300 feet per minute. The preheat, heat, and quench stages are approximately 10 to 24 feet long. As a consequence, the material is heated or quenched very rapidly in each stage on the order of only 6–15 seconds, for example, at a line speed of 100 feet per minute.

Representative equipment for accomplishing such heating is disclosed in U.S. Pat. Nos. 2,224,988 and 2,304,225 to Wood et al. Again, any heating and quenching media other than molten lead can be used for both the preheat and quench baths.

It is believed that the relatively short cycle times in the preheat, heat, and quench stages result in grain refinement and consequently increased strength. That is, in the preheat and heat stages, the strain introduced into the material from cold rolling causes recrystallization of the ferrite to a fine grain structure. The short cycle times limit grain growth keeping the grain size small, typically under 10 microns and frequently 3 to 4 microns and finer. In addition, small amounts of austenite form at the grain boundaries on heating and act to pin the grain boundaries against movement again serving to limit gain growth and resulting in higher strength levels. At the same time, the carbides in the pearlite are spheroidized and imperfections removed increasing the ductility of the steel. During the quench, the carbides precipitate introducing ductility and removing the potential for subsequent strain aging. The fine grained microstructure is illustrated by the photomicrographs in FIGS. 2 and 3.

SPECIFIC EXAMPLES

Figure 2:
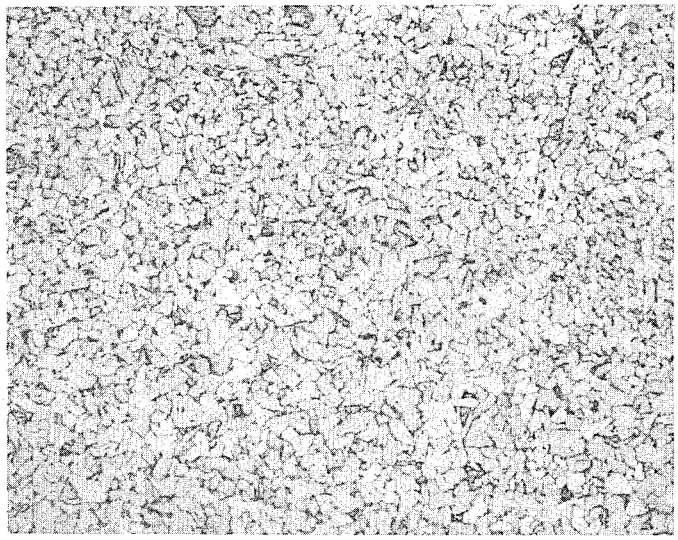
FIG. 2 is a photomicrograph taken at 500× magnification of one steel composition treated by the method of this invention.

Using the equipment described in FIG. 1, 2-inch wide by 0.044 inch thick steel strip cold reduced from 0.081 inch material was heat treated. The steel was aluminum killed for uniformity of properties and the composition contained 0.10% carbon, 0.40% manganese, 0.012% silicon and 0.057% aluminum, the silicon and aluminum components being residuals from the deoxidation of the steel before casting. The strip material traveled at a rate of 100 feet per minute. The length of the strip under the lead in the preheat bath was 10 feet, in the quench bath 20 feet, and in the heating stage 24 feet. Roller 14 was 8 feet above the lead baths. An optical pyrometer was used to measure strip temperature. The treatment schedule and resulting mechanical properties are set forth in Table I. A photomicrograph of the resulting microstructure is shown in FIG. 2.

TABLE I

| Sample Code | Preheat °F. | Strip Temp. °F. | Quench Temp. °F. | Tensile Strength (ksi) | Yield Strength (ksi) | % Elongation (2-inch qauge) | YS/TS | Hardness |
|---|---|---|---|---|---|---|---|---|
| 1-0 | 860 | 1725 | 690 | 73.3 | 66.0 | 26.7 | .90 | 86 |

TABLE I-continued

| Sample Code | Preheat °F. | Strip Temp. °F. | Quench Temp. °F. | Tensile Strength (ksi) | Yield Strength (ksi) | % Elongation (2-inch qauge) | YS/TS | Hardness |
|---|---|---|---|---|---|---|---|---|
| 2-0 | 775 | 1670 | 720 | 73.0 | 66.2 | 26.7 | .91 | 86 |

As may be seen from Table I, the mechanical properties resulting from the treatment process exceeded the minimum mechanical properties specified for grade 950 A,B,C,D (50 ksi yield strength, 70 ksi tensile strength, 22% elongation).

Figure 3:
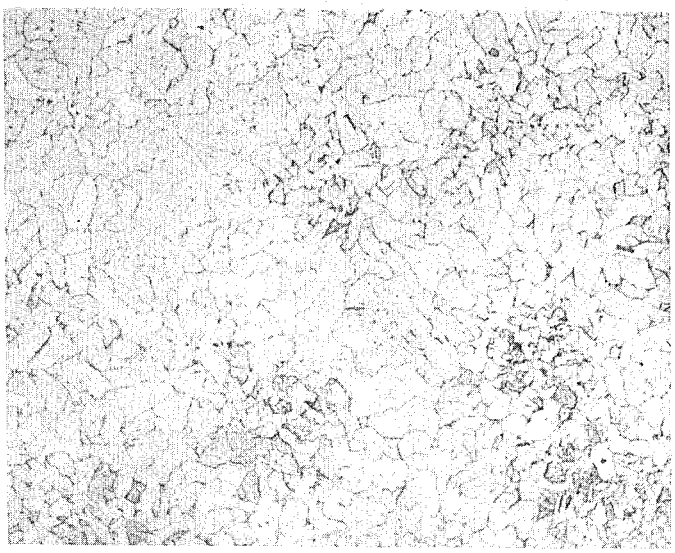
FIG. 3 is a photomicrograph taken at 500× magnification of another steel treated by the method of this invention.

A second, similar steel composition was run using the same process conditions. This composition comprised 0.04/0.06% carbon and 0.25/0.35% manganese. The treatment schedule and resulting mechanical properties are set forth in Table II. A photomicrograph of the resulting structure is shown in FIG. 3.

TABLE II

| Sample Code | Preheat °F. | Strip Temp. °F. | Quench Temp. °F. | Tensile Strength (ksi) | Yield Strength (ksi) | % Elongation (2-inch quage) | YS/TS | Hardness |
|---|---|---|---|---|---|---|---|---|
| 1-0 | 860 | 1725 | 690 | 61.5 | 54.9 | 28.7 | .89 | 75 |
| 2-0 | 775 | 1670 | 720 | 60.0 | 52.9 | 28.0 | .88 | 73 |

This material although lower in tensile strength than the previous example was characterized by excellent degree of elongation and thus would be expected to have a high degree of formability.

The method of the present invention is applicable to a range of steel compositions within the compositional limits set forth above. As the preceding specific examples show, the treatment method provides cold reduced steels with the desired combination of strength and ductility characterizing commercial hot rolled high-strength low-alloy steels.

Thus having described the invention, what is claimed is:

1. A method of treating steel in a continuous process wherein the steel is cold reduced and has a composition of from about 0.04% to 0.15% by weight carbon and 0.25% to 0.70% by weight manganese, without the addition of microalloying agents for the purpose of achieving enhanced mechanical properties, comprising the steps of:

(1) preheating the steel to a temperature in the range of 700° to 1000° F.;

(2) heating the steel to a temperature in the range of 1625° to 1725° F.; and (3) quenching the steel at a temperature in the range of 650° to 750° F.;

the treated steel having a minimum of 40,000 psi yield strength; 50,000 psi tensile strength; and 22% elongation.

2. A method for treating steel in a continuous process wherein the steel is cold reduced and has a composition of from about 0.10% to 0.15% by weight carbon and 0.25% to 0.70% by weight manganese, without the addition of microalloying agents for the purpose of achieving enhanced mechanical properties, comprising the steps of:

(1) preheating the steel to a temperature in the range of 700° to 1000° F.;

(2) heating the steel to a temperature in the range of 1625° to 1725° F.; and (3) quenching the steel at a temperature in the range of 650° to 750° F.;

the treated steel having a minimum of 50,000 psi yield strength; 70,000 psi tensile strength; and 22% elongation.

3. A method of treating steel in a continuous process wherein the steel is cold reduced and has a composition of from about 0.04% to 0.07% by weight carbon and 0.25% to 0.40% by weight manganese, without the addition of microalloying agents for the purpose of achieving enhanced mechanical properties, comprising the steps of:

(1) preheating the steel to a temperature in the range of 700° to 1000° F.;

(2) heating the steel to a temperature in the range of 1625° to 1725° F.; and (3) quenching the steel at a temperature in the range of 650° to 750° F.;

the treated steel having a minimum of 50,000 psi yield strength; 55,000 psi tensile strength; and 25% elongation.

4. A method of treating steel sheet and strip material in a continuous process wherein the steel material is cold reduced and has a composition of from about 0.04% to 0.15% by weight carbon and 0.25% to 0.70% by weight manganese, without the addition of microalloying agents for the purpose of achieving enhanced mechanical properties, comprising continuously passing the steel material through:

a molten lead bath held at a temperature in the range of 700° to 1000° F.;

a resistance heating stage wherein the material is heated to a temperature in the range of 1625° to 1725° F.; and a molten lead bath held at a temperature in the range of 650° to 750° F.;

the treated material having a minimum of 40,000 psi yield strength; 50,000 psi tensile strength; and 22% elongation.

5. The method of claim 4 wherein the steel has a carbon content in the range of 0.10% to 0.15% by weight and the treated material has a minimum of 50,000 psi yield strength; 70,000 psi tensile strength; and 22% elongation.

6. The method of claim 5 wherein the material has a cold reduced thickness in the range of about 0.020 to 0.060 inch.

7. The method of claim 4 wherein the material passes through the molten lead baths and resistance heating stage each in less than about 15 seconds.

8. A method of treating steel sheet or strip material in a continuous process wherein the steel material is cold reduced aluminum killed steel having a composition of from about 0.04% to 0.15% by weight carbon and 0.25% to 0.70% by weight manganese, without the addition of microalloying agents for the purpose of achieving enhanced mechanical properties, comprising continuously passing the steel material through:

a preheating bath held at a temperature in the range of 700° to 1000° F.;

a resistance heating stage wherein the material is heated to a temperature in the range of 1625° to 1725° F.; and a quenching bath held at a temperature in the range of 650° to 750° F.;

the treated material having a minimum of 40,000 psi yield strength; 50,000 psi tensile strength; and 22% elongation.

* * * * *